United States Patent [19]

Furutsutsumi

[11] 4,055,870

[45] Nov. 1, 1977

[54] HAND-OPERATED APPARATUS FOR PNEUMATICALLY REMOVING DUST

[76] Inventor: Yasuzi Furutsutsumi, 1-19, 2-chome, Midoridi, Kawanishi, Hyougo, Japan

[21] Appl. No.: 698,148

[22] Filed: June 21, 1976

Related U.S. Application Data

[63] Continuation of Ser. No. 535,554, Dec. 23, 1974, abandoned.

[51] Int. Cl.[2] ..... A47L 5/16

[52] U.S. Cl. ..... 15/409; 15/330; 15/345; 417/197

[58] Field of Search ..... 15/330, 345, 409; 239/DIG. 7, DIG. 22; 417/197

[56] References Cited

U.S. PATENT DOCUMENTS

| | | | |
|---|---|---|---|
| 2,074,666 | 3/1937 | Patalano | 15/409 |
| 2,475,832 | 7/1949 | Gilliland | 15/409 X |
| 2,746,078 | 5/1956 | Spurlin | 15/409 X |
| 2,851,213 | 9/1958 | Swallert | 15/409 X |
| 2,902,708 | 9/1959 | Riley | 15/409 X |
| 3,795,367 | 3/1974 | Mocarski | 417/197 X |
| 3,806,039 | 4/1974 | Mocarski | 239/417.3 |

*Primary Examiner*—Christopher K. Moore
*Attorney, Agent, or Firm*—Wenderoth, Lind & Ponack

[57] ABSTRACT

Dust removing apparatus includes an air valve operable by a trigger-type push button to permit or interrupt the flow of compressed air from a compressor into an air discharge passage. When the valve is opened, the compressed air flows through an annular slit into the air discharge passage at an increased pressure, producing suction at the inlet of an intake member by an ejecting action. The dust removing apparatus further includes another valve which, when in open position, changes the path of flow of air to force out the compressed air from a nozzle.

2 Claims, 4 Drawing Figures

A 18
5
4
18
16a
16
22
9
8
A

HAND-OPERATED APPARATUS FOR PNEUMATICALLY REMOVING DUST

This application is a continuation of application Ser. No. 535,554, filed Dec. 23, 1974 (now abandoned).

BACKGROUND OF THE INVENTION

The present invention relates to an apparatus for pneumatically removing dust by selectively causeing compressed air from a compressor to produce suction by an ejecting action or to jet from a nozzle so as to utilize the suction and a jet of the high-pressure air for the removal of dust.

Generally the operation in textile mills or machine shops produces large amounts of lint and cotton fuzz or metal dust and molding sand, so that it has been desired to provide a pneumatic apparatus for readily and efficiently removing such dust for the maintenance and improvement of the work environment.

However conventional dust removing apparatus incorporating a motor-driven pump or fan for example, are inacapable of giving a high suction and produce a harsh noise, and fail to effectively remove lint or metal dust, while the pump or fan and motor or like devices used makes the apparatus large-sized, complex in construction and troublesome to operate. Thus the known apparatuses have various drawbacks.

SUMMARY OF THE INVENTION

Accordingly, an object of this invention is to provide an apparatus for pneumatically removing dust which produces a high suction with a simple construction and which is operable with a low noise and usable with one hand.

Another object of this invention is to provide a pneumatic dust removing apparatus which is simple to operate, in compact in construction, is inexpensive to manufacture and is serviceable for a prolonged period of time.

Another object of this invention is to provide a pneumatic dust removing apparatus which is capable of jetting compressed air from a nozzle when the handle is operated manually.

Still another object of this invention is to provide a pneumatic apparatus which is safe to use in an environment involving the hazard of fire, is easy to assemble and disassemble, and is capable of withdrawing liquids.

For a better understanding of the preesent invention, an embodiment thereof will be described below in detail.

DETAILED DESCRIPTION OF THE PREFERRED EMBODIMENT

Figure 1:
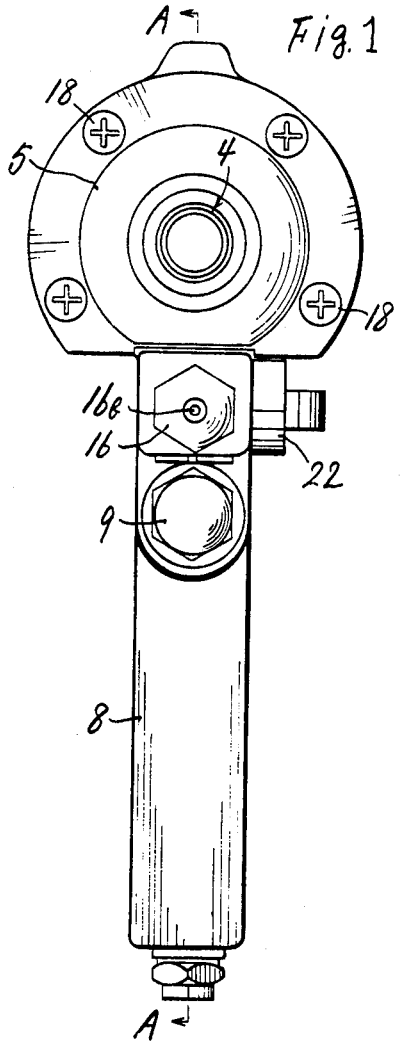
FIG. 1 is a front view showing an embodiment of the pneumatic dust removing apparatus of this invention.
Figures 2, 3, 4:
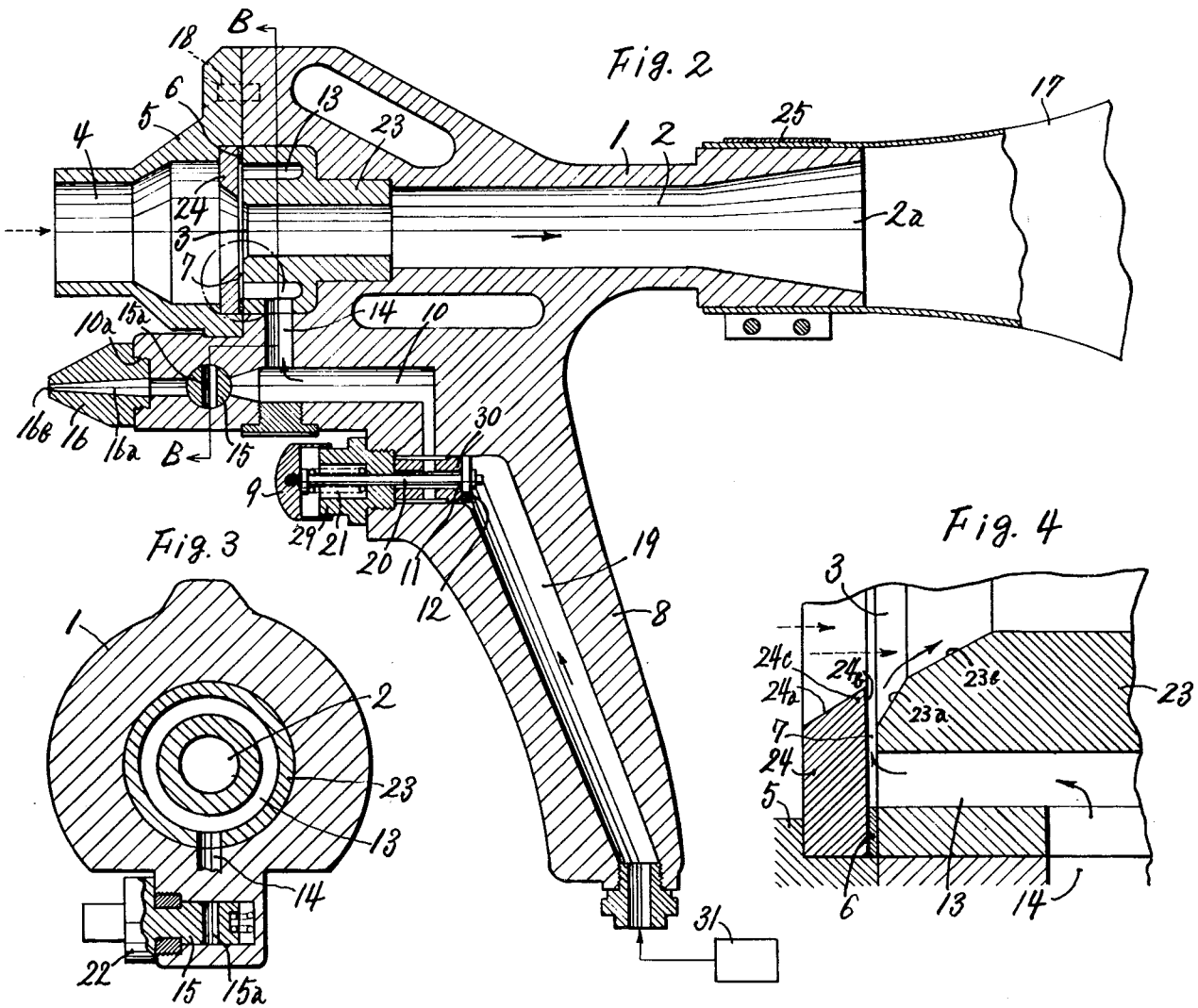
FIG. 2 is a view in section taken along the line A—A in FIG. 1.
FIG. 3 is a view in section taken along the line B—B in FIG. 2.
FIG. 4 is an enlarged view showing a portion encircled by the phantom line in FIG. 2.

With reference to FIGS. 1 and 2, an apparatus for pneumatically removing dust comprises a main body 1 having a handle 8 integral therewith and an intake member 5 fixed to the front end of the main body 1 by screws 18. The intake member 5 has an inlet 4. The main body 1 is the shape of a hollow cylinder formed with an internal air discharge passage 2 having an outlet 2a at its rear end, to which a dust bag 17 is removably attached by a fastening ring 25.

An annular member 23 is fitted in the front end of the main body 1 and has an opening 3 communicating with the air discharge passage 2 in the main body 1. The annular member 23 is formed with an annular chamber 13 which is open at its front end and surrounds the opening 3 concentrically therewith, with a partition wall provided therebetween. An air guiding ring holder 24 is mounted on the front end of the annular member 23, with a clearance adjusting ring plate 6 interposed therebetween and positioned concentrically with the annular member 23. The ring plate 6 is made of a very thin sheet of plastics or stainless steel and has an aperture having a diameter equal to the outer diameter of the annular chamber 13. Thus a fine clearance or an annular slit 7 is formed between the rear surface of the ring holder 24 and the front end of the above-mentioned partition wall of the annular member 23. The ring holder 24 is fitted in the rear end of the intake fixed to the main body 1.

With reference to FIG. 4 which is an enlarged view showing a portion of FIG. 2 encircled by the phantom line, the inner peripheral portion of the annular member 23 at its front end is formed with a first taper surface 23*a* and a second taper surface 23*b*. Similarly the inner periphery of the ring holder 24 is defined by a taper surface 24*a* flaring outward toward the intake member 5.

The handle 8 of the main body 1 includes a valve member 12 to be operated by a push button 9 of the trigger type to open and close a valve aperture 11 for an air inlet passage 19 extending through the handle 8 and adapted to communicate with a compressor 31. An air injection passage 10 communicating with the air inlet passage 19 by way of the valve aperture 11 communicates, through a bore 14, with the annular chamber 13 which further communicates with the slit 7 provided at the front end of the main body 1.

The push botton 9 for the valve member 12 is usually held projecting outward by the action of a spring 21 mounted on a valve rod 20. When depressed by the finger, the push button 9 pushes the valve rod 20 while compressing the spring 21, whereby the valve member 12 mounted on the valve rod 20 is brought out of contact with a valve seat 30 to open the valve aperture 11. Indicated at 29 is a socket for the push button 9.

Disposed at the front end of the air injection passage 10 is an air nozzle 16 adapted to communicate with the passage 10 by a valve element 15 of the hand-operated cock type. The air nozzle 16 is screwed into a threaded bore 10*a* in a front end lower portion of the main body 1 and projects from that portion. The valve element 15 has a bore 15*a* and is turnable by a knob 22 to open and close the air injection passage 10 (see FIGS. 1 and 3).

The front end of the intake member 5 is adapted to detachably mount intake nozzles (not shown) of various shapes suitable for versatile uses.

The dust remover having the foregoing construction will operate in the following manner. When the push button 9 is depressed with the passage 19 communicating with the compressor 31, the valve rod 20 moves the valve member 12 backward to open the valve aperture 11, whereupon compressed air introduced into the air inlet passage 19 flows through the air injection passage 10 into the annular chamber 13 since the valve element 15 is in closed position.

Inasmuch as the annular slit 7 serving as the outlet of the annular chamber 13 is a very fine clearance, the compressed air introduced into the annular chamber 13 is highly pressurized in the chamber 13 and is further compressed in the annular slit 7 to a higher pressure. The air then flows into the opening 3 toward the central inner portion thereof as shown in FIG. 4, and flows rearwardly along the tapered surfaces 23*a* and 23*b* towards the discharge passage 2.

Accordingly the compressed air flows smoothly from the front end opening 3 through the passage 2 into the dust bag 17, thereby producing suction at the inlet 4 of the intake member 5 owing to the ejecting action, whereby lint, minute fragments of metal or dust are withdrawn through the intake nozzle (not shown) attached to the front end of the intake member 5. The dust is guided by the taper surface 24*a* of the ring holder 24, passed through the passage 2 and collected in the bag 17.

The dust adhered to surfaces with oil or deposited in bores which is not removable by the abovementioned ejecting action can be removed in the follwing manner.

The valve element 15 as positioned for the foregoing operation is turned a specified angle (about 90° ) by the knob 22 for the air nozzle 16 to align the bore 15*a* of the valve element 15 with the air injection passage 10, thereby permitting the passage 10 to communicate with the bore 16*a* of the nozzle 16. As a result, the compressed air flowing into the annular chamber 13 from the passage 10 is predominantly forced out forward from the orifice 16*b* of the nozzle 16 though the bore 16*a* to remove or dispel the dust off the surface. The knob 22 is thereafter returned to the original position to withdraw the removed or dispelled dust into the dust bag 17.

Since the pneumatic dust remover of this invention is operable only by the flow of compressed air from the compressor unlike those of the conventional type composed of mechanically operable members including an electric motor, it is capable of withdrawing liquid and is safe to use in an environment where there is the hazard of fire because it does not include any electrically operable component.

Furthermore if the air nozzle is adapted to be detachably equipped with a spray attachment, various liquids can be sprayed by the present apparatus utilizing the jet of air from the nozzle.

It is to be understood that the present invention is not limited to the embodiment described in detail above. Various other modifications which may be made within the technical scope of this invention are all to be included in the scope of the claims given below.

What is claimed is:

1. A hand operated apparatus connected to an air source for pneumatically removing dust, said apparatus comprising:

handle means for holding said apparatus, said handle means having a first air passage therethrough connected to said air source;

cylindrical main body means having a second air passage longitudinally therethrough with an inlet and a discharge end for receiving and discharging dust particles therethrough, said main body means comprised of:

a cylindrical main body portion having said second air passage longitudinally therethrough, and an intake portion removably secured to the inlet end of said main body portion;

annular member means fitted within said cylindrical body means in said second air passage and connected to said first air passage for ejecting the air flowing from said air source through said first passage into said secondary passage toward the discharge end thereof, said annular member means comprised of:

an annular member positioned within said second air passage between said intake portion and said main body portion, said annular member having a first central opening therethrough aligned with said second air passage, the forward end of said first central opening having an inwardly tapered surface, and said annulr member further having an annular chamber spaced from and surrounding said first central opening, said annulr chamber being open at the front portion thereof toward the front of said annular member and connected to said first air passage, a ring plate adjacent said annular member between the outer circumference of said annular member and said annular chamber, a ring holder next to said ring plate on the side thereof opposite said annular member having a second central opening therethrough aligned with said first central opening through said annular member and having a slanted surface extending circumferentially inwardly toward said central openings, whereby an annular slit is formed between said ring holder and said annular member due to the presence of said ring plate thereinbetween, and whereby air in said annular chamber is forced outwardly through said annular slit and flows rearward along the tapered surface of said annulr member through said first central opening toward the discharge end of said main body portion;

manually operable first control valve means in said first air passage for regulating the flow of air through said first air passage from said air source;

nozzle means connected to said handle means and operatively connected to said first air passage for ejecting the air coming from said air source through said first air passage outward therethrough; and second air valve means between said first control valve means and said nozzle means for controlling the flow of air from said first air passage to said nozzle means.

2. An apparatus as claimed in claim 1 wherein said intake portion is so shaped as to detachably mount intake nozzles of various forms thereon.

* * * * *